United States Patent [19]

Wolf

[11] Patent Number: 4,846,237

[45] Date of Patent: Jul. 11, 1989

[54] METHOD AND APPARATUS FOR SAWING ROUND WOOD TRUNKS

[75] Inventor: Johann Wolf, Scharnstein, Austria

[73] Assignee: Johann Wolf GmbH KG, Scharnstein, Austria

[21] Appl. No.: 174,353

[22] Filed: Mar. 28, 1988

[30] Foreign Application Priority Data

Apr. 13, 1987 [EP] European Pat. Off. ..... 87105436.7

[51] Int. Cl.[4] ..... B27B 1/00

[52] U.S. Cl. ..... 144/377; 144/3 R; 144/162. R; 144/369; 144/378

[58] Field of Search ..... 144/369, 370, 378, 1 R, 144/3 R, 162 R, 39, 41, 377

[56] References Cited

U.S. PATENT DOCUMENTS

| | | | |
|---|---|---|---|
| 3,457,978 | 7/1969 | Ahlstedt | 144/378 |
| 3,552,457 | 1/1971 | Bos | 144/370 |
| 4,239,069 | 12/1980 | Zimmerman | 144/370 |
| 4,711,279 | 12/1987 | Reuter | 144/39 |
| 4,750,535 | 6/1988 | Wolf | 144/373 |

FOREIGN PATENT DOCUMENTS

| | | | |
|---|---|---|---|
| 78429 | 6/1962 | France | 144/370 |

*Primary Examiner*—W. Donald Bray
*Attorney, Agent, or Firm*—Wm. D. Johnston, III

[57] ABSTRACT

Round wood trunks are formed into beams, boards, etc. shaped on all sides, each round wood trunk being continuously flattened along its lengthwise direction in each of several working steps. In each feeding operation of the round wood trunk, it is simultaneously flattened on at least two sides.

23 Claims, 2 Drawing Sheets

METHOD AND APPARATUS FOR SAWING ROUND WOOD TRUNKS

BACKGROUND OF THE INVENTION

The invention concerns a process and an apparatus for sawing round wood trunks. It particularly involves a process and an apparatus for working round wood trunks into beams, boards, etc. shaped on all sides.

Such an all-sided working in the known art requires a lot of time and is also expensive. If it is desired to save working steps, then large segments of the surface of the round trunk can be sawed off or otherwise removed; but this involves a large loss of material. If it is desired to keep the material loss low, then many working steps are required, which requires time and is accordingly costly.

SUMMARY OF THE INVENTION

A purpose of the invention is to provide a process to saw or otherwise provide flat surfaces on all sides of round wood trunks with low time and cost requirements.

Thus the flat sides formed in a working step by the sawing or surfacing of the round wood trunks can lie opposite each other, be directly adjacent each other, or border on an already formed flat surface or one to be formed later. The choice of the number of sides to be worked in one feeding or working operation can be selected in correspondence to the work tools employed.

According to a preferred embodiment of the invention, three sides of the round wood trunk are worked in one feeding pass of a working process.

Preferably, in such a pass the round beam or tree trunk is worked along its entire length. The round trunk is provided with flat surfaces according to its conical shape or a selected conicity, corresponding to its natural growth. This feature of the invention reduces the material loss to a minimum.

According to the present invention, the round trunk can be surfaced on four, six, eight, ten or twelve sides. The more sides that are formed, the smaller are the cuts and the material loss.

According to a preferred embodiment of the invention, three sides are flattened in each of first and second passes, with an angle greater than 90 degrees between each adjacent pair of flattened surfaces. This allows a working of the round trunk with a few working passes or feeding steps, and with relatively simple tools, as described further below.

The embodiment further has the advantage that the number of flattened surfaces or sides is not fixed, but can be allowed to be varied.

The round tree trunk can after the first pass be rotated by 180 degrees and worked in a second pass with mirror symmetry. Thus the same tools can be used for providing the further flat surfaces, such as saws of any kind or tools for removing the wood material.

According to another embodiment of the invention, the round wood trunk is simultaneously worked in the same working step or feeding operation of the wood trunk with a second apparatus, which is placed 180 degrees mirrorwise with respect to the first apparatus, and which can be moved towards and away from the round wood trunk. According to the number of tools in each apparatus, it is possible in this further embodiment to simultaneously work a round wood trunk in one feeding operation on four, six, eight or ten sides. By moving individual tools towards and away from the round wood trunk, the conicity of the round wood trunk can be followed in flattening the sides.

It is also possible to carry out both the working steps in one feeding operation of the round trunk, by use of a second apparatus placed 180 degrees mirrorwise with respect to a first apparatus, the two apparatuses each having respective removal tools and being located one after the other along the length of the trunk.

If each work apparatus is operated with three tools, and if it is desired to flatten the surface of the trunk on eight sides, then the two remaining sides can be flattened by two opposing saws or removal tools, or they can be removed in separate worksteps.

Also advantageous is the flattening on 12 sides. This goal is achievable according to the present invention in several ways, for example by four feeding or passing operations through an apparatus with three tools, by two passes through a pair of apparatuses arranged mirrorwise and each having three tools, or in one pass with the appropriate plurality of apparatuses arranged one after the other in the direction of feeding.

A further object of the invention is to provide an apparatus for sawing or flattening a round wood trunk on all sides.

This object is provided according to the present invention by providing two removal tools or saws with parallel axes, and on both sides of these two a further removal tool, the axis of each further removal tool having an angle with respect to the parallel axes that is less than 90 degrees.

The invention has a surprising number of advantages.

It can be seen immediately that with an apparatus according to the invention a round wood trunk can be simultaneously worked on three sides in one feeding operation. According to the process described above, a round trunk can be worked on all sides with this apparatus.

This apparatus also makes it possible to work a round trunk and produce a four-sided beam. To this end the round trunk can be simultaneously worked on three sides in each feeding operation, and finally the remaining round surfaces can be removed by the removal tools set with parallel axes to provide smooth surfaces. The apparatus according to the invention makes possible the economic working of round wood trunks into beams with four, six, eight, ten, twelve or yet more sides.

The apparatus according to the invention has the further advantage that it can easily be used to cut the beam worked on all sides into boards. According to a further feature of the invention, the removal tools may generally have parallel axes and be adjustably set relative to each other, in a direction transverse to the feeding or lengthwise direction of the round trunk. The width of each area cut through by the two tools with parallel axes, which in the middle of the round trunk is greater than in the other planes, can thus be adjustably provided for.

The removal tools described above can be of any arbitrary type, for example circular saws, chain saws, or any other saws or tools for removing the wood material. Wherever saws are referred to herein, it is to be understood that other types of tools within the scope of the invention are intended to be included, so long as they produce the desired effect.

The tools arranged on the sides of the above two tools for providing the common flat surface are provided to be adjustable in their angle relative of these two. Thus the apparatus according to the present invention is suitable for working round wood trunks into beams or profiles of nearly any arbitrary external shape.

The two removal tools with parallel axes, for example saws, are placed one behind the other in relation to the feeding movement, and so arranged that their cutting circles slightly overlap. In this way the flat surface is produced without leaving behind any splinters sticking up. Further, the danger of any interference between the two saw tools with parallel axes is avoided.

The continuous feeding operation is provided as desired by the lengthwise movement of the working tools or by the lengthwise movement of the round wood trunk. Thus a working of the round trunk according to its geometry is possible.

According to another form of carrying out the invention, the feeding for the production of the flattenings along the natural surface of the trunk is at a small angle with respect to the axis of the trunk.

The working tools can be moveably located as appropriate in a support with adjustable inclinations.

In this connection it is noted that the apparatus according to the invention allows the working of round wood trunks in a variable desired manner. Thus it can be used to work a round trunk into a piramid-shaped beam, whose surfaces are all trapezoids. It also allows the working of round trunks into beams which are in part conical or trapezoidal, but which can also have diametrically opposing flat surfaces which are parallel to each other.

According to another embodiment of the invention, a carriage with a support means for holding the round trunk at an adjustable angle can be provided, on which the trunk is fixed and moved past a stationary work tool.

The work tools in this embodiment of the invention are arranged to be moveable to and away from the round wood trunk, corresponding to the continuous working path.

It is advantageous for the tools to be moveable to definite angles and to be fixable at these positions. For example, the tools can be inverted by 180 degrees and fixed in this position.

According to another embodiment of the invention, the four axes of the saws or removal tools can be fixed with respect to each other, or can be brought to and fixed at another position. Thus the geometry of the beam to be formed from the working of the round wood trunk can be adjustably controlled.

The inclined axes of the saws or removal tools on both sides of the saw tools with parallel axes are rotatable, and can be set at an angle of 90 degrees with respect to the parallel axes of the saws.

The removal tools are moveable toward and away from the round wood trunk to correspond to the surfaces of the round wood trunk, in accordance with the continuous feeding of the round trunk, at least in the 90 degree position above. By this means the inclination of the flat surfaces worked by these tools can be set as desired.

The inclined saws or removal tools on both sides of the saws with parallel axes are movable toward or away from the round wood trunk, at a right angle to the parallel axes of the saws. This embodiment of the invention has the advantage for instance that the beams formed from the round trunks can be worked by the saws with parallel axes, without being hindered by the side worktools which can be moved sufficiently far away to the side.

If the entire round wood trunk is to be worked into boards or smaller profiles, a six-sided flattening is also to be considered, since in this case one working step can be eliminated.

For cutting the boards etc., the two inclined saws on the sides are moved outward to be out of the way, and the cutting of the boards is performed in several steps by the saws with parallel axes. According to another embodiment of the invention, the path for leading the tools, that is, the operation of the feeding carriage, is provided so that the feeding path runs parallel to the axis of the round trunk.

In the place of this feeding carriage can also be used an adjustable chain pull, for feeding the round wood trunk.

The formation of the apparatus, in particular for the feeding and for the setting of the inclination of the feeding path, can also be provided in any other sufficient way.

The essential purpose of the invention is to flatten round wood trunks on eight or six sides, corresponding to their natural conical shape, and to work at least three sides in each feeding operation. Thus the waste can be held to the least possible, while desired profiles are worked on all sides.

Naturally, according to space relationships for a feeding working, any number of other combinations are possible.

The invention is described in more detail in the following, with respect to various examples and the drawings.

DESCRIPTION OF PREFERRED EMBODIMENTS

Figure 1:
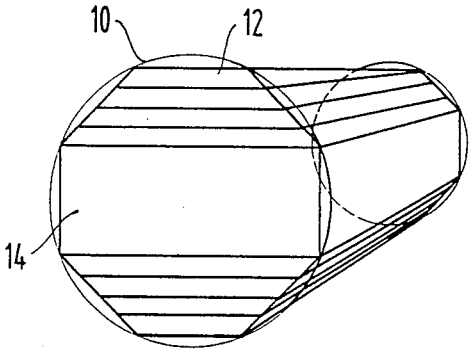
FIG. 1 shows an eight-sided flattening, and further indicates the corresponding working to provide boards and a conical beam.

FIG. 1 shows a form which is obtained from flattening a round wood trunk on eight sides, the starting shape 10 of the wood trunk being indicated. This form is to be further worked into boards 12 and a conical (trapezoidal) beam 14.

Figure 2:
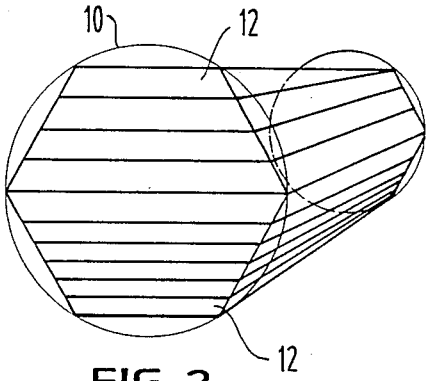
FIG. 2 shows a six-sided flattening of a round wood trunk, and indicates the further working to provide different strong boards.

FIG. 2 shows a form that is obtained from flattening a round wood trunk with the indicated starting shape 10 on six sides, which form is then sawed into different thick boards 12.

Figure 3:
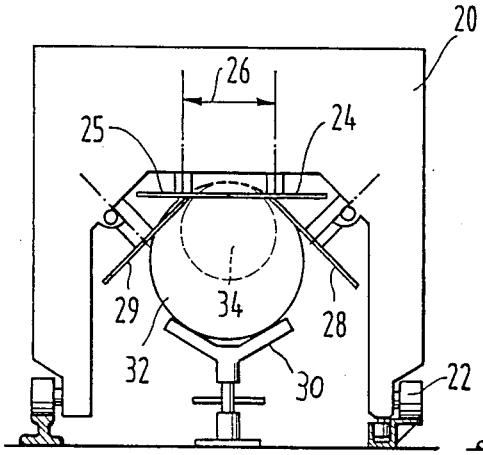
FIG. 3 indicates schematically a working unit with saws for a three-sided working.

FIG. 3 shows a working unit according to the invention. Two circular saws 24 and 25 are fastened with their axes in parallel on a moveable carriage 20 mounted on wheels 22. These saws 24, 25 can be spaced apart transversely with respect to the direction of motion of the working unit, as indicated by the double-headed arrow 26 between the two axes.

To the right and left of the saws 24, 25 with parallel axes are arranged two saws or other removal tools 28 and 29, tilted at a substantial angle therefrom.

Inside the open cross-section of the carriage 20, a round wood trunk 32 is supported on the supports 30, which are adjustable in height. As indicated by the small end 34 of the trunk (shown with the dotted line), the trunk is held in the supports 30 so that the upper surface of the trunk is horizontally oriented. The round trunk is thus supported at a height so that the two saws with parallel axes are where the upper flat surface is to be formed.

To work the round trunk, the carriage 20 of the working unit traverses once the entire length of the trunk. Thus the trunk is simultaneously flattened on three sides.

The trunk lying on its supports 30 is then turned about its axis by 180 degrees, and the supports 30 are set at a desired height. Then the working unit again traverses the entire length of the trunk 32 with the saws running, so that three other sides of the trunk 32 are simultaneously flattened.

Figure 4:
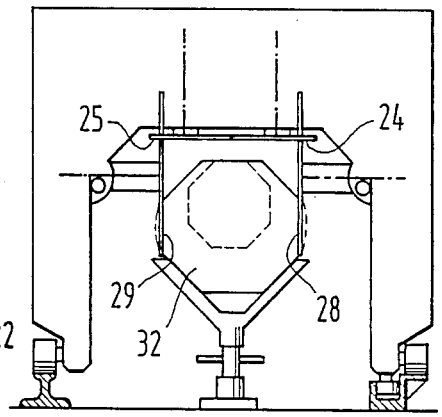
FIG. 4 shows the unit of FIG. 3, with the side saws set at 90 degrees.

FIG. 4 shows the working unit of FIG. 3, but wherein it is set for the flattening of the two remaining sides of the trunk. To achieve this purpose the two saws 24, 25 with parallel axes are pulled into their upper end position, to provide a definite clearance above the trunk. The two saws 28, 29 on the side are both vertically oriented When the working unit is in this position, with saws 28, 29 running, and traverses the entire length of the trunk with six flat sides and two curved sides, the two curved sides are cutoff.

This example above of the carrying out of the invention, described in connection with sawtools 28 and 29, is not to be understood as limiting in any regard the scope of the present invention. If the tools 28, 29 for removing wood are to be moved towards or away from the axis of the trunk, during the displacement of the working unit along the length of the trunk, then the best tool 28, 29 to use is of the type which removes all the wood material down to the flat surface to be formed.

The reference numerals 24, 25, 28 and 29 are meant to indicate entirely generally any suitable type of wood-removing or flat-surfacing tool. Thus, instead of circular saws or wood-removing tools one could use for example chainsaws or some type of blade saws.

As seen from FIGS. 3 and 4, the working unit displayed therein allows the flattening of a round trunk on eight sides with only three working passes or feeding operations.

Figure 5:
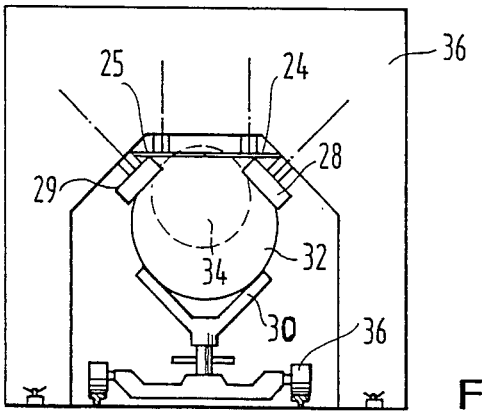
FIG. 5 shows a fixed unit provided with saws and tools for removing the wood. The round wood trunk rests on an adjustable carriage for transport which is on rails and is continuously moved under the worktools.

In FIG. 5 is represented another embodiment for the carrying out of the invention. Two saws 24, 25 with parallel axes and two inclined removal tools 28, 29 are mounted on a gate-forming, stationary stand 36 of a working unit. The round trunk is held in the stands 30, which are adjustable in height and moveable on wheels 36. In this embodiment the round trunk is moved with respect to the working unit. The saws 24, 25 with parallel axes are again mounted to be adjustable in height, and the side removal tools 28, 29 are mounted so as to be moveable both as to height and angle.

Figure 6:
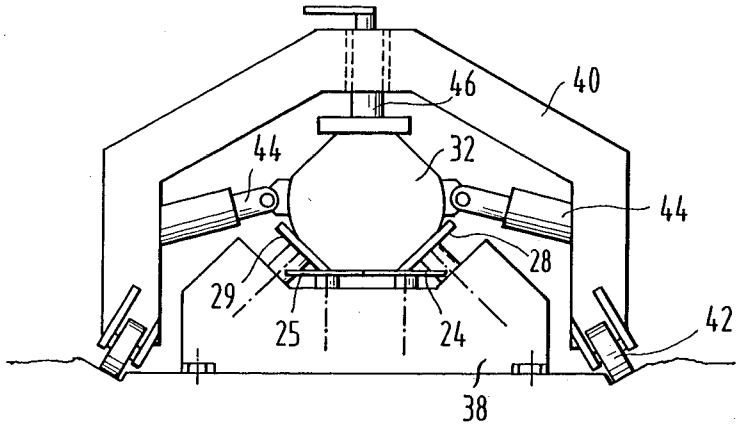
FIG. 6 shows an analogous fixed apparatus, in which the underside of the round wood trunk is worked. The trunk is pressed from both sides by the hydraulic pads, up against the bracket set above it at the desired position, so that the underside of the trunk comes to lie parallel to the rails.

FIG. 6 shows a stationary base 38 anchored to the floor and having a concave upper side carrying the adjustable saws 24, 25 with parallel axes and the side removal tools 28,29. On a cart 40, which is moveable by wheels 42 running on rails, are provided hydraulic units 44 and an adjustable upper piece 46. The round trunk is pressed up against the piece 46 and held there by the pressure from the hydraulic units 44, while the cart 40 moves the trunk in the working direction, and thus the trunk 32 is simultaneously flattened on three sides by the removal tools 24, 25, 28, 29.

Figure 7:
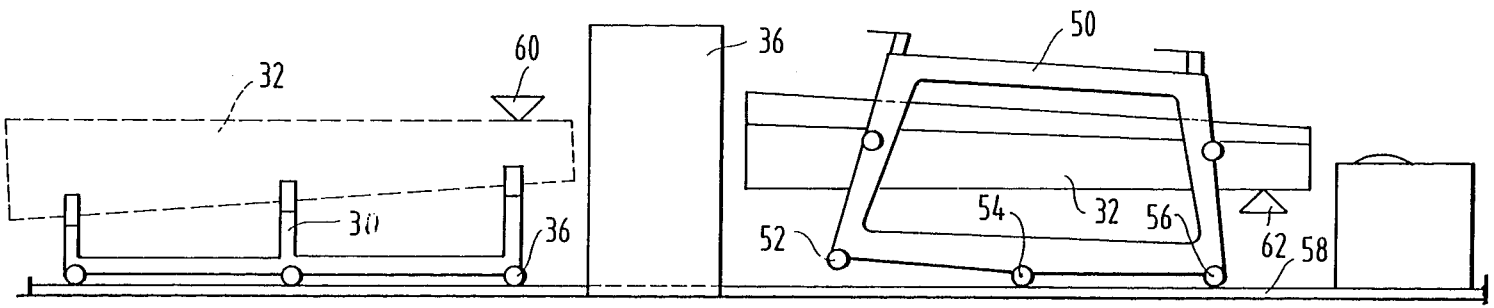
FIG. 7 shows schematically a carriage for working the upper and underside of the trunk, as a further possible embodiment.

FIG. 7 shows schematically an arrangement for the continuous working of the upper and lower sides of the trunk, as a further embodiment of the present invention. In the first stage of the working, as shown on the left in FIG. 7, the working of the upper side occurs according to FIG. 5. In the second stage, as indicated on the right in FIG. 7, that is after the feeding of the trunk through the working unit 36, the trunk is transferred to a carriage 50 which can tip (see-saw), the trunk being held according to the arrangement of FIG. 6, with the left and middle rollers 52, 54 in contact with the rails 58. After the withdrawal of the cart with the moveable stand 34, 36 as in FIG. 5, the tipping carriage 50 is tipped to the position shown on the right in FIG. 7. During the transfer of the round trunk, its upper side is parallel to the rails, as shown by the triangle 60 in FIG. 7. As a result of tipping the carriage 50 to contact the right rollers 56, the underside of the trunk 32 comes into a position parallel to the rails, at the height indicated by the triangle 62. For exact arrangements, one of the outer pairs of rollers 52 or 56 of the tilting carriage 50 is provided to be adjustable in height.

The present invention allows for a variety of modifications, extensions and numerous advantageous applications, as would be apparent to a worker in the art in possession of the present disclosure. Various combinations are possible in any particular application, depending on positional relationships and other properties.

What is claimed is:

1. An apparatus for working round wood trunks into beams, boards and other profiles flattened on a plurality of sides, comprising two first removal tools arranged to each provide a respective part of a common flat surface along the length of the wood trunk when the wood trunk is moved lengthwise with respect to said two first removal tools each said first removal tool providing a respective part of said common flat surface along said length of the wood trunk, and two second removal tools arranged at respective opposite sides of said two first removal tools, each said second removal tool being inclined to provide a respective flat surface along the length of the wood trunk on the respective side of said common flat surface, each said respective flat surface being inclined, with respect to the exterior of said flattened wood trunk, at less than 90 degrees with respect to said common flat surface.

2. The apparatus of claim 1, wherein said two first removal tools are circular saws with parallel axes of rotation, and said two circular saws are arranged one after the other in a direction along said length of the wood trunk, and with a spacing between said parallel axes in a direction transverse to said direction along said length of the wood trunk, so that the circular cuts of said two circular saws overlap for forming said common flat surface.

3. The apparatus of claim 1, comprising transport means for providing a relative feeding operation of said first and second removal tools along the length of the wood trunk.

4. The apparatus of claim 3, wherein said transport means and at least one pair of said first and second removal tools operate so that at least one respective one of said flat surfaces of the wood trunk is at an angle with respect to the central axis of said round wood trunk, each said angle of said at least one flat surface with respect to said central axis corresponding to the natural conicity of said wood trunk or a selected conicity.

5. The apparatus of claim 4, comprising means for supporting said first and second removal tools and moving them toward and away from the wood trunk in correspondence with said relative feeding operation, wherein each said flat surface is formed thereby at each said angle with respect to said central axis of the wood trunk.

6. The apparatus of claim 3, comprising said first and second removal tools being stationary, and said transport means comprising cart means for carrying the wood trunk at an adjustable slope past said first and second removal tools for the respective flattenings to occur.

7. The apparatus of claim 3, wherein said transport means provides a continuous feeding motion of the wood trunk past said first and second removal tools for each of a plurality of passes of said length of said trunk, and said apparatus further comprises steering means for steering predetermined one of said first and second removal tools respectively towards and away from the wood trunk in correspondence with the continuous relative feeding operation of the wood trunk.

8. The apparatus of claim 1, comprising means for supporting predetermined ones of said first and second removal tools so that they can be swung to and fixed at each of a predetermined plurality of angles.

9. The apparatus of claim 1, comprising support means for said first and second removal tools, wherein said removal tools can be swung from a first fixed position 180 degrees around the wood trunk to a second fixed position.

10. The apparatus of claim 1, comprising support means for said first and second removal tools, wherein said first and second removal tools are stationarily fixed with respect to each other at a first position, and can be brought to another position where they are also stationarily fixed to each other.

11. The apparatus of claim 3, comprising support means for said first and second removal tools, wherein said second removal tools are oppositely inclined with respect to said first removal tools and can be rotated to an angle so that further respective flat surfaces can be provided by said second removal tools at 90 degrees to said common flat surface and separated from said common flat surface by the respective flat surfaces which are inclined at less than 90 degrees with respect to said common flat surface.

12. The apparatus of claim 11, said support menas comprising means for steering said second removal tools toward and away from the wood trunk during said feeding operation of said wood trunk, in correspondence to a conical shape of said wood trunk, at least when said second removal tools are in said respective positions to provide said respective flat surfaces at said 90 degrees.

13. The apparatus of claim 1, comprising support means for holding said two second removal tools to the respective ones of said flat surfaces of the wood trunk at right angles to said common flat surface, and for steering said two second removal tools to selectively slant said respective flat surfaces toward and away from the central axis of the wood trunk.

14. The apparatus of claim 3, wherein the positions of said two first removal tools are essentially adjustable relative to each other in a direction transverse to the length of the wood trunk, and a plurality of said flat surfaces are effectively parallel to respective parts of a natural conicity of said wood trunk.

15. The apparatus of claim 3, wherein the inclination of each of said two second removal tools with respect to said common flat surface is adjustable, and a plurality of said flat surfaces are effectively parallel to respective parts of a natural conicity of said wood trunk.

16. The apparatus of claim 3, wherein each said first and second removal tool is a circular saw, said two circular saws having parallel axes of rotation, and a plurality of said flat surfaces are effectively parallel to respective parts of a natural conicity of said wood trunk.

17. A method for working a round wood trunk into beams, boards and other profiles that are flattened on all sides, comprising flattening the wood trunk on all said sides by providing a plurality of feeding operations each along the entire length of the wood trunk, wherein said wood trunk is flattened on at least two sides in each said feeding operation and, by said flattening on all sides, said wood trunk is flattened on a total of six, eight, ten or twelve sides.

18. The method of claim 17, said wood trunk having a conicity corresponding to its natural growth, said method comprising flattening said sides of said wood trunk according to said conicity of said trunk.

19. A method for working a round wood trunk into beams, boards and other profiles that are flattened on all sides, comprising flattening the wood trunk on all sides by providing a plurality of feeding operations each along the entire length of the wood trunk, wherein three of said flattened sides are provided in said wood trunk in each of a first and a second of said feeding operations, and each said flattened side adjoining another of said flattened sides defines an inclination angle therebetween that is substantially less than 90 degrees, each said inclination angle being with respect to the exterior of said flattened trunk, between a projection of a first of said adjoining flattened sides and the second thereof.

20. The method of claim 19, comprising rotating the wood trunk about its axis by 180 degrees after said first feeding operation, wherein the flattened sides formed during the second of said feeding operations have a mirror symmetry with respect to the flattened sides formed during said first feeding operation.

21. A method for working a round wood trunk into beams, boards and other profiles that are flattened on all sides, comprising flattening the wood trunk on all sides by providing a plurality of feeding operations each along the entire length of the wood trunk, wherein: said wood trunk is flattened on at least three sides in each of a plurality of said feeding operations, and on two sides in each other of said plurality of said feeding operations, a first and a second framework are employed for holding respective removal tools for forming said flattened sides during said feeding operations; said respective removal tools on said second framework are rotatable with respect to those on said first framework by 180 degrees around the central axis of the wood trunk; and respective plural ones of said flattened sides provided by said respective removal tools on both said frameworks are formed in each of a first and a second of said feeding operations.

22. The method of claim 21, comprising performing said flattening of said sides utilizing an apparatus wherein said first and second frameworks constitute a single integrated framework for all of said respective removal tools.

23. The method of claim 1, said flattening of said sides of the wood trunk comprising performing said flattening of at least one of said sides of said wood trunk in at least one further one of said feeding operations.

* * * * *